US007823368B2

(12) United States Patent
Hansen et al.

(10) Patent No.: US 7,823,368 B2
(45) Date of Patent: Nov. 2, 2010

(54) APPARATUS FOR PACKAGING MINERAL WOOL PRODUCTS

(75) Inventors: Lars Elmekilde Hansen, Hedehusene (DK); Claus Egholm Sørensen, Hedehusene (DK)

(73) Assignee: Rockwool International A/S, Hedehusene (DK)

( * ) Notice: Subject to any disclaimer, the term of this patent is extended or adjusted under 35 U.S.C. 154(b) by 340 days.

(21) Appl. No.: 10/589,893

(22) PCT Filed: Feb. 21, 2005

(86) PCT No.: PCT/DK2005/000113

§ 371 (c)(1),
(2), (4) Date: Jun. 11, 2007

(87) PCT Pub. No.: WO2005/080208

PCT Pub. Date: Sep. 1, 2005

(65) Prior Publication Data

US 2007/0277479 A1 Dec. 6, 2007

(30) Foreign Application Priority Data

Feb. 20, 2004 (EP) ..... 04388010

(51) Int. Cl.
*B65B 31/00* (2006.01)
*B65B 63/02* (2006.01)

(52) U.S. Cl. ..... 53/510; 53/526; 53/528; 53/529; 100/90

(58) Field of Classification Search ..... 53/510, 53/511, 523, 526–529; 100/90; *B65B 63/02*
See application file for complete search history.

(56) References Cited

U.S. PATENT DOCUMENTS 3,321,889 A * 5/1967 Zubick et al. ..... 53/511
3,382,643 A * 5/1968 Hullhorst et al. ..... 100/90
3,499,261 A * 3/1970 Hullhorst et al. ..... 100/90
3,848,398 A 11/1974 Suhr (Continued)

FOREIGN PATENT DOCUMENTS

CA 2090125 2/1992

(Continued)

*Primary Examiner*—Stephen F Gerrity
(74) *Attorney, Agent, or Firm*—Finnegan, Henderson, Farabow, Garrett & Dunner, L.L.P.

(57) ABSTRACT

An apparatus for making a substantially air-tight foil package for mineral wool that includes a mechanical compressing device for compressing the mineral wool in a first direction to bring about a dimensional reduction thereof. A wrapping device encloses the mineral wool with a web of a substantially air-tight foil. An evacuating station is arranged downstream of the compressing device and it includes an evacuating device for evacuating air from the mineral wool compressed by the compressing device and enclosed by the foil. The evacuating station includes opposed surfaces for maintaining the dimensional reduction during transfer to the evacuating means of the foil enclosed mineral wool compressed by the compressing device. The opposed surfaces maintain the dimensional reduction during evacuation by the evacuating device.

8 Claims, 5 Drawing Sheets

U.S. PATENT DOCUMENTS

Figure 1:
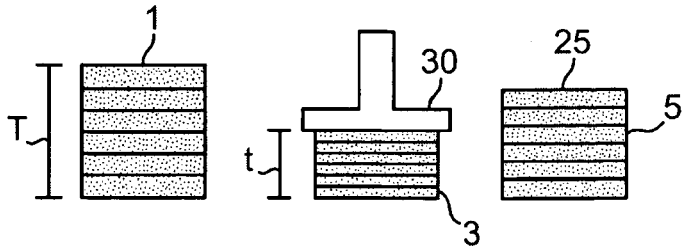

| | | | | | |
|---|---|---|---|---|---|
| 4,069,643 | A | * | 1/1978 | Young et al. | 53/511 |
| 4,110,954 | A | * | 9/1978 | Olsson et al. | 53/511 |
| 4,377,061 | A | * | 3/1983 | Olson et al. | 53/511 |
| 4,404,788 | A | * | 9/1983 | Svenang | 53/512 |
| 4,711,067 | A | * | 12/1987 | Magni | 53/439 |
| 4,738,078 | A | * | 4/1988 | Benz et al. | 53/439 |
| 4,852,331 | A | * | 8/1989 | Bogh | 53/510 |
| 4,953,344 | A | * | 9/1990 | Wallace | 53/528 |
| 5,177,935 | A | * | 1/1993 | Jones et al. | 53/511 |
| 5,226,269 | A | * | 7/1993 | Stoltenberg | 53/511 |
| 5,447,012 | A | * | 9/1995 | Kovacs et al. | 53/511 |
| 5,706,635 | A | * | 1/1998 | Simmons | 53/511 |
| 5,979,145 | A | * | 11/1999 | Louis et al. | 53/439 |
| 5,981,024 | A | * | 11/1999 | Noergaard et al. | 428/107 |
| 6,708,465 | B1 | * | 3/2004 | Gustafsson | 53/511 |

FOREIGN PATENT DOCUMENTS

| | | | |
|---|---|---|---|
| DE | 3444897 | A1 * | 6/1986 |
| DE | 40 26 807 | | 3/1992 |
| DE | 100 29 503 | A1 | 1/2002 |
| EP | 0 733 551 | | 9/1996 |
| JP | 59-1314 | | 1/1984 |
| WO | WO 02/10021 | | 2/2002 |

* cited by examiner

APPARATUS FOR PACKAGING MINERAL WOOL PRODUCTS

The present invention relates to a novel method for providing and maintaining a dimensional reduction of a mineral wool product by making a package. The invention also relates to a novel apparatus for packing a mineral wool wherein a dimensional reduction is obtained and maintained. Additionally, the invention relates to a novel dimensionally reduced mineral wool product.

When packing mineral wool products the overall dimension of the product is normally reduced to facilitate transport to the end user and also reduce the space required for storing the product.

In particular, when packing mineral wool slabs used in the building industry for insulating purposes stacks of slabs are formed, and the height of the stacks is reduced such that the stacks delivered to the end users will exhibit a reduction of the original height of 15%-50%, in the case of stone wool the reduction being typically in the order of 15%-30%.

Normally this dimensional reduction is done by mechanically compressing the stack within the elastic limit, and a foil is wrapped around the stack in an effort to maintain the reduced height. Due to the natural tendency of the mineral wool boards to reassume their original dimension, the compressed stack seeks to expand after the mechanical compression. The foil wrapped around the compressed stack will yield by some degree such that an original height reduction of eg. 50% at the compression stage often shows itself as a height reduction of no more than about 18% in the stacks that are actually delivered to the end user, the foil stretching and the geometrical shape of the packaging changing. Obviously, this expansion is undesirable for transport reasons.

One way of obtaining a greater final height reduction could be by compressing the stack even further at the compression stage and wrapping the compressed stack even tighter. However, beyond a certain level of compression the qualities of the final product are reduced.

Applicant has tested alternative methods, such as an evacuation process wherein a foil is first wrapped around a stack of mineral wool boards and hermetically sealed following which this package is evacuated. However, the density variations in mineral wool products unavoidably manifest themselves as distinctive variations in the surface contour of the evacuated mineral wool product. Hence, the evacuated package appears with a highly irregular surface reflecting the relief of the surface of the uppermost board in the package, and this may lead to the end-users having doubts as to the quality of the product.

Applicant has now discovered that a dimensional reduction may be obtained in accordance with the invention by subjecting the mineral wool product to a mechanical compression and evacuating the mineral wool product air-tightly enclosed by an air-tight foil. The evacuation process reduces the pressure of the air within the porous mineral wool product, preferably to a level where the difference between that pressure and the atmospheric pressure substantially balances the external pressure that must be applied mechanically to provide the required dimensional reduction. The mineral wool product should preferably be enclosed by the foil in a fully hermetical manner to reach the best result.

The package formed by the invention has a highly regular surface brought about by the mechanical compression homogenizing the mineral wool product whereby the surface of the final product will lack the surface irregularities that would otherwise result from a pure evacuation process as described above.

According to a preferred embodiment, the dimensional reduction is essentially maintained by evacuating the mineral wool product enclosed by the foil to an extent where the difference between atmospheric pressure and the internal pressure within the package comprising the mineral wool product enclosed by the foil corresponds essentially to that applied by the mechanical compressing means.

According to further embodiments the foil may be wrapped around the mineral wool product before, during or after the mechanical compression. Evacuation may be by connecting the evacuation means to an opening formed in the foil after the foil wrapped around the mineral wool product has been hermetically sealed. The pressure may be monitored and the evacuation stopped when the sub-atmospheric pressure within the package has reached a desired level.

According to yet another embodiment of the invention, the foil may be wrapped closely and tightly around the mineral wool and the foil is then sealed without actively applying a vacuum. After release of the mechanical compression the package will expand slightly and a vacuum is generated inside the package ensuring that no further expansion of the package will occur. Evacuation may be carried out using an air suction pump.

In addition, by the mineral wool product having substantially parallel opposed surfaces and by the mechanical compressing means applying a uniform pressure there against, such as by the compressing means including a flat surface press, an increased degree of homogenization of the mineral wool product is obtained.

Preferably, the mechanical compression of especially stone wool is less than 70%, preferably less than 60%, of the original dimension of the mineral wool product. The compression is thereby held within the limit of what is conventionally considered to be the elastic limit of especially stone wool products. For glass wool products the mechanical compression may be selected to be less than 95%, preferably less than 85%.

For practicing the invention use may be made of an apparatus as defined in claim 12 that comprises mechanical compressing means and a foil wrapping means arranged upstream or downstream thereof, and an evacuation means. Preferably, the evacuation means is separate from the compressing means, the dimensional reduction of the mineral wool product being temporarily maintained during the transfer thereof to the evacuation means, such as by opposed surfaces defining a gap within which the product in conveyed to the evacuation means. The evacuation means may include any conventional equipment, such as air pumps and sealing devices required to evacuate the mineral wool product, such as through an opening formed for that purpose in the foil wrapped around the mineral wool product.

Figure 4:
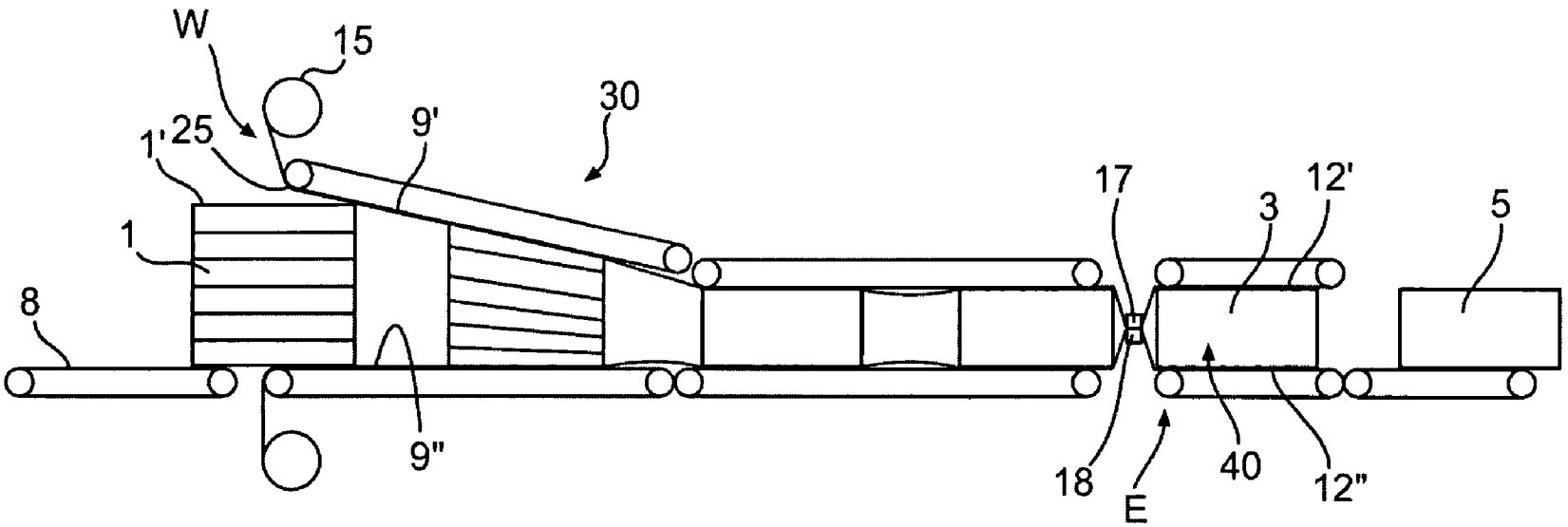

The invention will now be described in further detail with reference to the drawing where FIG. 1 shows the dimensional changes of a stack of mineral wool boards in a compression and foil wrapping process, FIGS. 2*a-e* show the packing method and apparatus according to a first embodiment of the invention, FIGS. 3*a-e* show the packing method and apparatus according to a second embodiment of the invention, and FIG. 4 show the packing method and apparatus according to a third embodiment of the invention.

FIG. 1 shows a stack 1 of height T of six mineral wool boards or batts/slabs having parallel surfaces, such as boards made of individual glass fibers or rock wool fibers bonded by a bonding agent, to be compressed within the elastic limit of the material to yield a stack 3 of reduced height t. Conventionally, the compression is brought about using a compressing means in the form of a movable press 30 which provides an even vertical pressure against the upper surface of the stack, and a foil 25 is then wrapped around the compressed stack 3.

Due to the natural tendency of the elastic mineral wool boards to reassume the original dimension, the stack 3 expands again after leaving the press 30 to assume the height of stack 5 shown schematically in FIG. 1, this expansion being determined by the stretchability of the foil 25 and the change in geometrical shape of the package as it assumes a more rounded shape. Furthermore, if the foil has not been wrapped sufficiently tight around the mineral wool, the extra, loose foil may also allow for some expansion. As an example, when compressing a 600 mm stack 1 of six 100 mm×600 mm×920 mm boards to a height t of 300 mm, i.e. to a height of 50% of the original height T, release of the press 30 causes the wrapped stack to expand to a height of typically about 492 mm, i.e. a dimensional reduction of about 18%-22% is achieved, the foil stretching accordingly.

The expansion of the stack is disadvantageous for several reasons, one being that the handling of the stack 5 is more cumbersome as compared to a stack 3 of a smaller height t. Secondly, the transport to the end users of the mineral boards involves higher costs since fewer mineral wool boards can be carried in a truck as compared to stacks where no expansion has taken place.

To obtain a finished stack 5 of a desired reduced dimension, such as a 50% height reduction as compared to the original height, one might either use a different quality less stretchable foil or choose to compress the stack 1 even further by press 30 so as to obtain a smaller height of the stack 3 which is subsequently wrapped by the foil. However, using foils of the stated nature would incur higher production costs, and a higher compression of the mineral wool boards by press 30 may lead to a significant reduction of the qualities of the boards, in particular the mechanical qualities. Hence, the final expansion of the stack has so far been accepted as representing a compromise between costs and quality of the product.

Figure 2A:
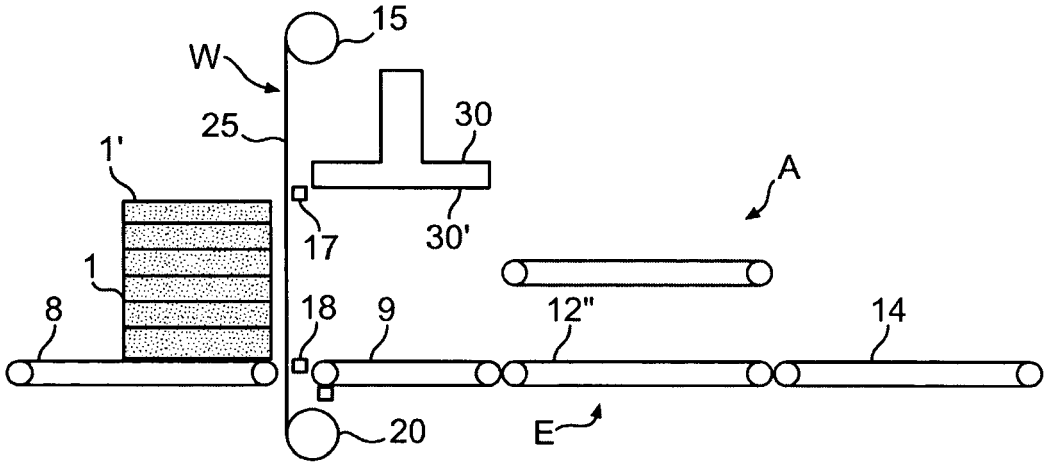

FIG. 2*a-e* shows an embodiment of an apparatus A suitable for practicing the method of the invention. The apparatus includes a plurality of conveyor belts 8, 9, 12", 14 defining a conveyor path along which a stack 1 of mineral wool boards is conveyed for providing a dimensional reduction. FIG. 2*a* shows an uncompressed stack 1 of mineral wool boards having dimensions such as mentioned with respect to FIG. 1 and supported by conveyor belt 8.

Next to the stack 1 is a wrapping device W including a supply roll 15 of a web of a foil 25 and receiving means 20 for receiving an end of the web. The foil 25 extends across the path of the stack 1 and may have a width out of the plane of the drawing in excess of the sum of twice the length and twice the width of the stack 1. As the stack 1 moves to the right in FIG. 2*a* against the foil 25, the foil 25 is unwound from supply roll 15 and wrapped around the stack 1 to enclose the stack 1 by guiding means (not shown). Alternatively, a further wrapping device may be provided which provides for the vertical sides of the stack 1 to be covered by a separate foil in which case the wrapping device W shown in FIG. 2*a* needs only operate with a web having a width out of the plane of the drawing corresponding essentially to the dimension of the stack 1 out of the plane of the drawing.

Figure 2B:
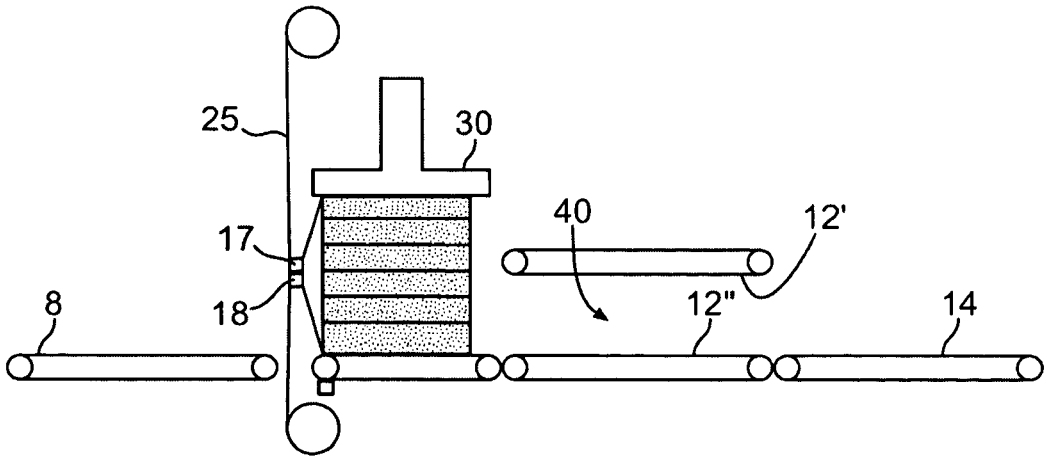

FIG. 2*a* also shows two movable sealing bars 17, 18 movable to the position shown in FIG. 2*b* and adapted for cutting off foil 25 from the supply roll 15 and for sealing together the free edges of the cut-off length of foil 25 enclosing the stack 1. The sealing means 17, 18 also ensures the integrity of the web extending between supply roll 15 and receiving means 20 by additionally forming seam 26' shown in FIG. 2*d*. Additional sealing means may be provided as required, such that the stack 1 in accordance with the invention becomes hermetically sealed within the foil 25.

Figure 2C:
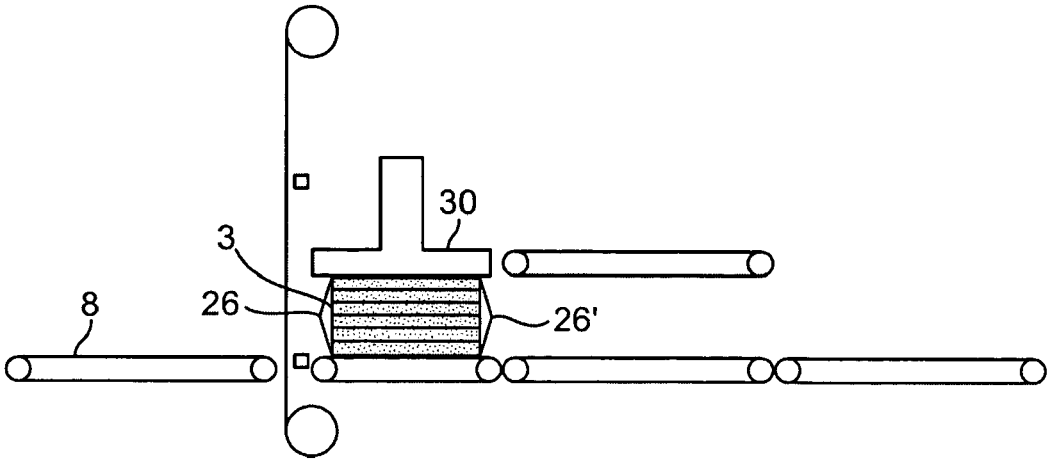

FIG. 2*b* shows a compressing means 30 in the form of a vertically movable press having a plane surface 30' extending parallel with the upper surface 1' of wrapped stack 1, and FIG. 2*c* shows the press 30 in a vertically displaced position wherein the press 30 has compressed the stack 1 into compressed stack 3 having a reduced height of 50% of the original height. FIG. 2*c* shows seams 26 and 26' formed by the sealing means 17, 18, the foil 25 hanging at this point of time around the stack 3 with some slack. It will be understood that the press moves to compress the stack 1 in the vertical direction, this being an exemplary direction as referred to in the claims herein.

The surface 30' of press 30 and the upper surface of opposed conveyor 9 should preferably be non-yielding such that the upper and lower surfaces of the stack 3 are essentially plane and regular after this compression. During this compressing process internal bonds between the individual mineral fibers may be locally broken, such as in areas of higher fiber density, whereby the surface of the stack 3 has an even regular appearance.

In order to move the non-evacuated package from the press 30 to the evacuation station E the package is pushed or otherwise conveyed by mechanical means, the top surface of the package sliding across the surface 30' of the press; a horizontally moving piston device may be used for this purpose.

Figure 2D:
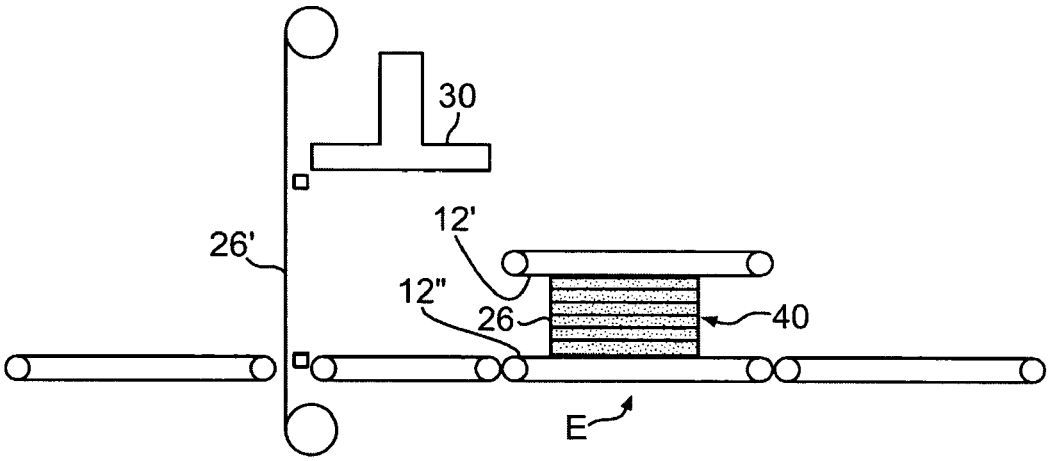
Figure 2E:
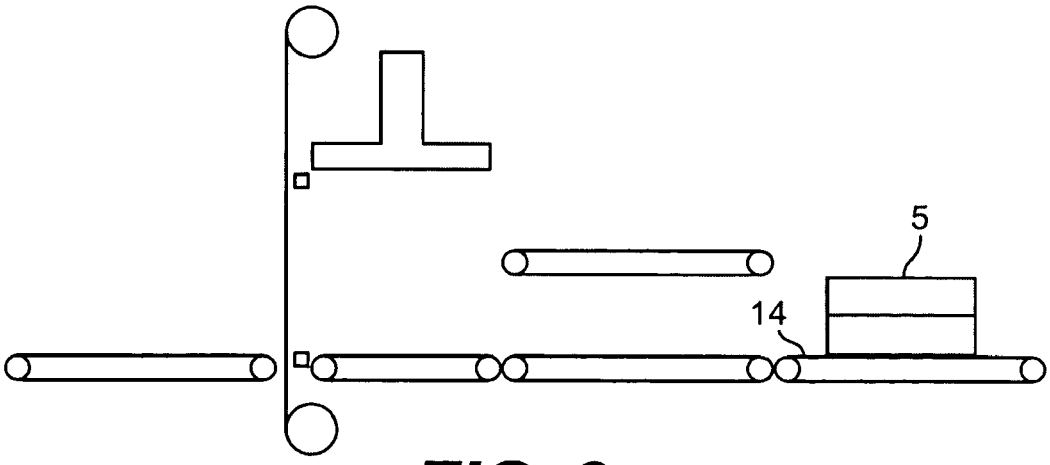
Figure 3A:
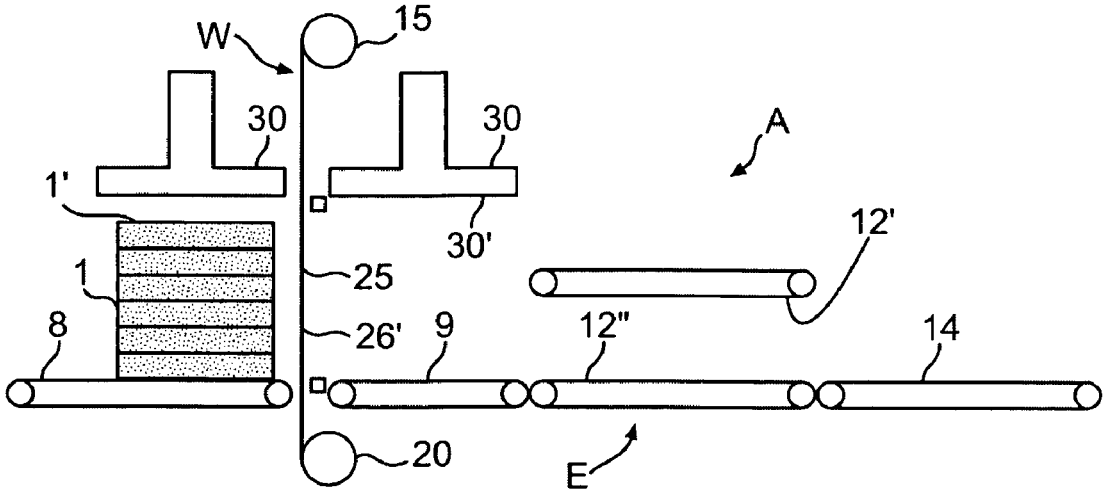
Figure 3B:
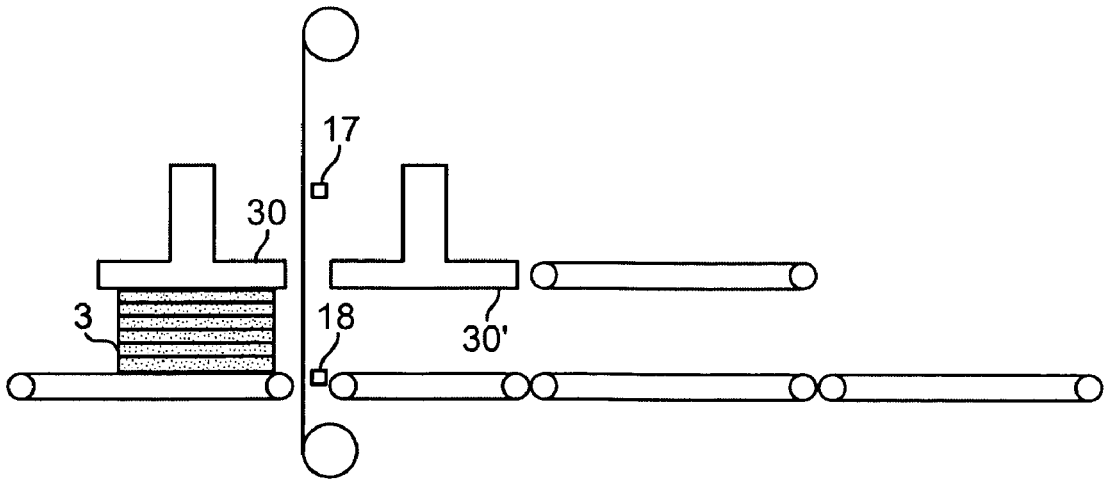
Figure 3C:
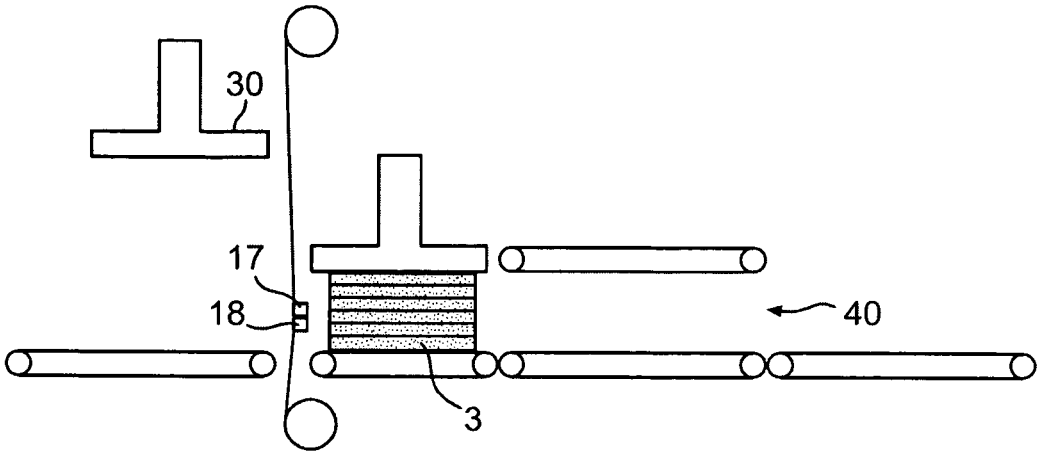
Figure 3D:
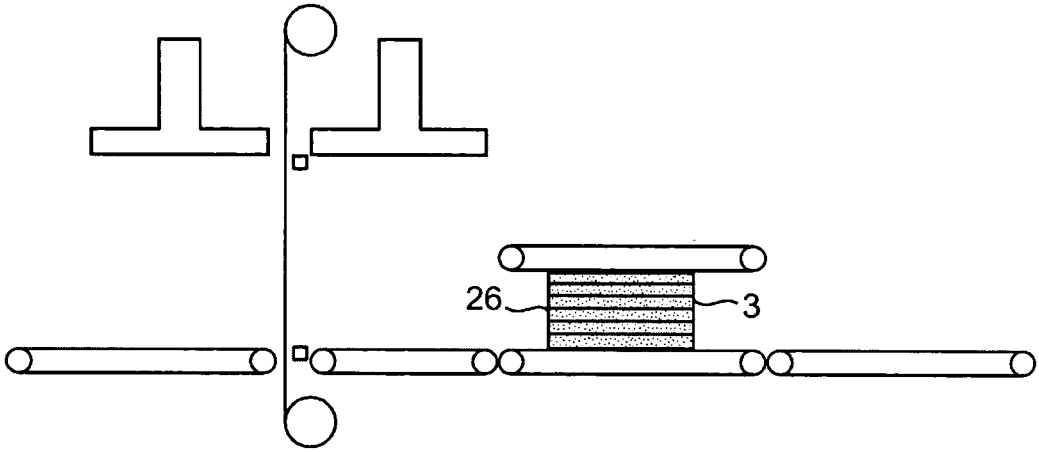
Figure 3E:
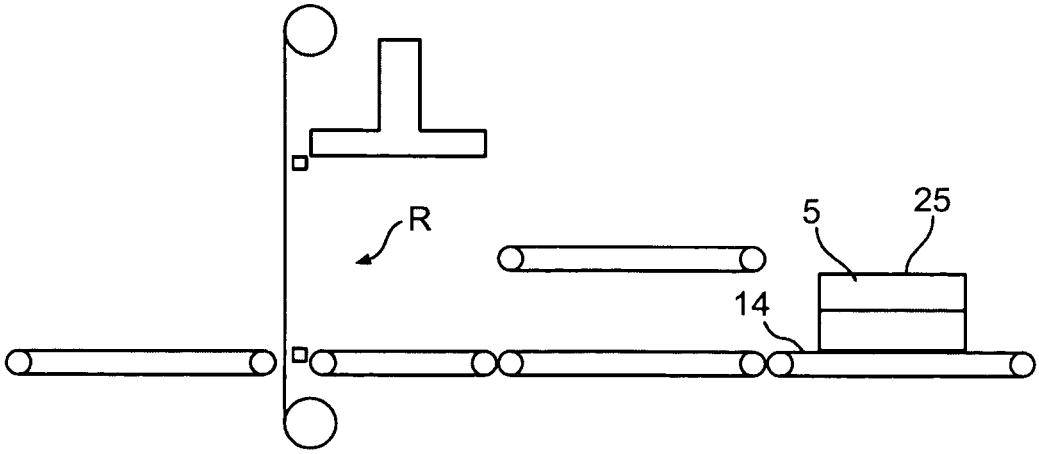

FIG. 2*d* shows the stack 3 now having been moved by the conveyor 9 into the gap between two opposed vertically fixed flat belt conveyors 12', 12" forming part of an evacuation station E, this gap having a width corresponding to the height of the compressed stack 3 with the foil 25. Additional sealing means (not shown) may be provided at this place, to completely seal, such as by welding, the stack 1 within the foil 25, if such a complete seal has not been established already in the position of the stack 1 shown in FIG. 2*b*. Evacuation means 40 is arranged at the evacuation station E and is adapted to be connectable such as by suitable tubing to the inside of the foil 25 wrapped around the stack 3 to perform evacuation i) simultaneously with or in connection with any sealing of the foil 25 carried out in this position of the stack, or ii) by eg. a hole formed in the foil 25 for this purpose, if the foil 25 has already been completely sealed in the position shown in FIG. 2*b*.

It will be understood that in the position shown in FIG. 2*d* the stack 3 exerts a pressure against the flat belt conveyors 12', 12" of the evacuation station E corresponding essentially to the pressure applied by press 30 during the compression stage shown in FIG. 2*c*. Sensing means (not shown) may be provided for monitoring the force on the conveyor belts 12', 12" exerted by the stack 3 seeking to reassume its original height.

Evacuation means 40 is activated so as to remove air from the inside of foil 25, the pressure within the foil 25 optionally being monitored. When the pressure applied by the stack 3 against the conveyor 12' reaches a desired value, preferably a zero value, corresponding to a certain pressure within the foil 25 wrapped around the stack 3, evacuation means 40 is disconnected, and the foil 25 is sealed where the evacuation means tubing was connected. The finished stack 5 is then moved on to conveyor 14 and onwards to a finished product storage area.

It is noted that, if welding is carried out in connection with, or simultaneously with, the evacuation, welding means may be provided at evacuation station E for welding foil along one side of the stack 1 enclosed by the foil 25 at a time, or along both sides at the same time. Means may be provided for gathering the foil 25 at the respective side; such means may also stretch the foil so that it is ready for sealing and evacuation at that side.

FIGS. 3*a-e* shows an alternative apparatus similar to the one shown in FIGS. 2*a-e* but where the compressing means 30 is arranged upstream of the foil wrapping device W such that the foil 25 is wrapped around the compressed mineral wool product. This involves the advantage that the foil slack mentioned above with reference to FIG. 2*c* is avoided. As explained above in connection with FIG. 2*d* additional sealing means (not shown) may be provided at the evacuation station E shown in FIG. 3*a-e*, to completely seal, such as by welding, the stack 1 within the foil 25, if such a complete seal has not been established already in the position of the stack 1 shown in FIG. 3*b*. Evacuation means 40 is arranged at the evacuation station E and is adapted to be connectable such as by suitable tubing to the inside of the foil 25 wrapped around the stack 3 to perform evacuation with the stack 1 in the position shown in FIG. 3*d* i) simultaneously with or in connection with any sealing of the foil 25 performed in that position, or ii) by eg. a hole formed in the foil 25 for this purpose, if the foil 25 has already been completely sealed in the position shown in FIG. 3*b*.

It is noted again that, if welding is carried out in connection with, or simultaneously with, the evacuation, welding means may be provided at evacuation station E for welding foil along one side of the stack 1 enclosed by the foil 25 at a time, or along both sides at the same time. Means may be provided for gathering the foil 25 at the respective side; such means may also stretch the foil so that it is ready for sealing and evacuation at that side.

Although described above and shown in FIGS. 2*a-e* and 3*a-e* as comprising a flat surface press arranged above a belt conveyor, the compressing means 30 may alternatively be formed by two belt conveyors, such as belt conveyors 12', 12", arranged at a distance from one another with one conveyor being displaceable in a direction towards and away from the other conveyor so as to carry out the required compression.

FIG. 4 shows an alternative apparatus where wrapping means W are operable to wrap the foil 25 around the mineral wool product 1 during the mechanical compression. The mechanical compressing means 30 shown in FIG. 4 includes first and second opposed conveyors 9', 9" for conveying the stacked mineral wool product along a given path, and the conveyors 9', 9" define a passage of decreasing width providing the dimensional reduction of the mineral wool product as it is being advanced. The wrapping means W includes a supply 15 of the foil 25 and receiving means for receiving an end of the web of the foil 25, and the web of the foil 25 extends between the supply 15 and the receiving means across the path of the mineral wool product to receive the mineral wool product.

Again, sealing means 17, 18 are operable to seal the foil 25 hermetically around the compressed mineral wool product after the wrapping, and evacuating means 40 at evacuation station E is operable to evacuate the mineral wool product enclosed by the sealed foil 25. Evacuation station E may include a perforation means that makes a hole in the foil 25 for connection of the stack 1 wrapped with the foil 25 to the evacuation means 40. After reaching the desired pressure within the foil the evacuation means 40 is disconnected and a sticker is applied to seal the hole. In FIG. 4, the evacuation station E is shown as being located next to sealing means 17, 18. It may be desirable to provide for two opposed conveyors similar to conveyors 12', 12" shown in FIG. 4 between sealing means 17, 18 and the evacuation station E, i.e. to arrange the evacuation station E further downstream as compared to the location shown in FIG. 4.

Alternatively, evacuation may be carried out simultaneously with, or in connection with, the welding of the sides of the foil 25 by sealing means 17, 18 to hermetically enclose the stack 1.

EXAMPLE

A 600 mm stack comprising six 100 mm rock wool boards having upper surface dimensions of 600 mm×920 mm (surface area=0.552 $m^2$) and a density of 30-32 $kg/m^3$ was compressed using a force of 500 kg evenly applied on the upper surface thereof to obtain a 50% reduction of the height, i.e. a height of 300 mm. The pressure applied on the surface of the stack was calculated as P=500/0.552=906 $kg/m^2$=89 mbar. Evacuation means was then connected to this package and the pressure within the package required to balance this pressure P and, hence, maintain the 50% dimensional reduction, was set to 89 mbar below atmospheric pressure, an air-tight foil hermetically enclosing the stack. The package resulting from this process had a smooth surface and the 50% dimensional reduction was maintained.

The invention claimed is:

1. An apparatus for making a package comprising a mineral wool product substantially air-tightly enclosed by a foil, comprising mechanical compressing means adapted for receiving said mineral wool product and for compressing said mineral wool product in a first direction to bring about a dimensional reduction thereof, wrapping means for enclosing said mineral wool product with a web of a substantially air-tight foil, an evacuating station arranged downstream of said compressing means, said evacuating station including evacuating means for evacuating air from said mineral wool product compressed by said compressing means and enclosed by said foil, a plurality of opposed surfaces, at least a portion of which are arranged between said compression means and said evacuation means, the opposed surfaces for maintaining said dimensional reduction during transfer of said mineral wool product from said compressing means to said evacuating means, said opposed surfaces maintaining said dimensional reduction during said evacuation by said evacuating means.

2. The apparatus according to claim 1, wherein said wrapping means is operable to wrap said foil around said mineral wool product before activation of said mechanical compressing means for bringing about said dimensional reduction, said wrapping means comprising sealing means operable to seal said foil after said wrapping, said evacuating means being operable to evacuate said mineral wool product enclosed by said sealed foil.

3. The apparatus according to claim 2, including conveyor means for conveying said mineral wool product along a path, said wrapping means including a supply of said web and receiving means for receiving an end of said web, said web being extendable between said supply and said receiving means across said path to receive said mineral wool product in a receiving area, said compressing means being arranged downstream of said receiving area.

4. The apparatus according to claim 1, wherein said wrapping means is operable to wrap said web around said mineral wool product after activation of said mechanical compressing means for bringing about said dimensional reduction, said wrapping means comprising sealing means operable to seal said foil after said wrapping, said evacuating means being operable to evacuate said mineral wool product enclosed by said sealed foil.

5. The apparatus according to claim 4, including conveyor means for conveying said mineral wool product along a path, said wrapping means including a supply of said web and receiving means for receiving an end of said web, said web being extendable between said supply and said receiving means across said path to receive said mineral wool product in a receiving area, said compressing means being arranged upstream of said receiving area.

6. The apparatus according to claim 1, wherein said compressing means includes a flat surface displaceable press.

7. The apparatus according to claim 1, wherein said wrapping means is operable to wrap said web around said mineral wool product during activation of said mechanical compressing means to bring about said dimensional reduction, said wrapping means comprising sealing means operable to seal said foil after said wrapping, said evacuating means being operable to evacuate said mineral wool product enclosed by said sealed foil.

8. The apparatus according to claim 7, wherein said mechanical compressing includes first and second opposed conveyor means for conveying said mineral wool product along a path and defining therebetween a passage of decreasing width for obtaining said dimensional reduction, said wrapping means including a supply of said web and receiving means for receiving an end of said web, said receiving means for receiving an end of said web, said web being extendable between said supply and said receiving means across said path to receive said mineral wool product in a receiving area, said compressing means being arranged downstream of said receiving area.

* * * * *